US008607665B1

(12) United States Patent
Hung

(10) Patent No.: US 8,607,665 B1
(45) Date of Patent: Dec. 17, 2013

(54) ROTARY TABLE DEVICE WHICH CAN BE TUNED FLEXIBLY TO OPERATE INDIVIDUALLY

(76) Inventor: Kun-Jung Hung, Hsinchu (TW)

( * ) Notice: Subject to any disclaimer, the term of this patent is extended or adjusted under 35 U.S.C. 154(b) by 177 days.

(21) Appl. No.: 13/209,375

(22) Filed: Aug. 13, 2011

(51) Int. Cl.
*F16H 48/12* (2012.01)

(52) U.S. Cl.
USPC ..... 74/650

(58) Field of Classification Search
USPC ..... 74/665 A, 665 F, 650
See application file for complete search history.

(56) References Cited

U.S. PATENT DOCUMENTS 6,401,841 B1 * 6/2002 Eilertsen ..... 175/195
7,603,930 B2 * 10/2009 Kato et al. ..... 74/813 R
7,798,071 B2 * 9/2010 Ishikawa et al. ..... 108/20
8,316,776 B2 * 11/2012 Taniguchi et al. ..... 108/20

* cited by examiner

*Primary Examiner* — Ha D Ho
(74) *Attorney, Agent, or Firm* — Pro-Techtor Int'l Services

(57) ABSTRACT

A rotary table with a main frame, at least two driving wheels, at least two driven wheels, a round inner seal plate and a round outer seal plate. The main frame is provided with an inner and outer annular track region. Driving-wheel emplacement regions are at proper locations on the outer annular track region and driven-wheels are installed in a drive-wheel annular track region between the inner and outer annular track regions. The driving wheels are installed in the driving-wheel emplacement regions of the main frame. A side of the drive-wheel is connected with a sliding block. The driven wheel is matched and gnawed with the driving wheel which can drive individually the matched and gnawed driven wheel to rotate and displace to perform plural manufacturing processes of a short machine-hour and plural fixed sites, such that all the manufacturing processes can be accomplished simultaneously.

4 Claims, 9 Drawing Sheets

ROTARY TABLE DEVICE WHICH CAN BE TUNED FLEXIBLY TO OPERATE INDIVIDUALLY

BACKGROUND OF THE INVENTION a) Field of the Invention

The present invention relates to a rotary table device which can be tuned flexibly to operate individually, and more particularly to a rotary table, wherein manufacturing processes of plural fixed sites, a long machine-hour and a short machine-hour can be tuned flexibly to operate individually by a few dies (mounts), so that the operation time, the cost of dies (mounts) and the die-change time can be reduced, thereby decreasing the percent defective and increasing the capacity.

b) Description of the Prior Art

It is known that when ordinary rotary tables are operating, there must be an equal amount of dies (mounts) to the number of fixed-site manufacturing processes and the rotary tables can rotate together only after accomplishing the manufacturing process that spends the longest time to proceed with the next manufacturing process. The existing rotary table device is provided with several shortcomings:

1. There are a lot of dies (mounts), which increases the cost,
2. The labor time and fees for repairing and die changing will be increased.
3. There is a higher probability to result in a larger tolerance when processing, installing and tuning plural dies (mounts) and therefore, the product stability will be reduced, correspondingly.
4. It is unable to flexibly tune the operation time of each fixed-site manufacturing process.
5. When a manufacturing process needs to be displaced immediately after accomplishing in a short machine-hour to proceed with the next manufacturing process, the manufacturing process that spends the longest time must be accomplished before all the rotary tables displace together to the next manufacturing process. Therefore, the prime time is missed and the percent defective will be increased.
6. It is relatively more difficult for the manufacturing process to increase the fixed sites.

SUMMARY OF THE INVENTION

Accordingly, the primary object of the present invention is to provide a rotary table device which can be tuned flexibly to operate individually, wherein manufacturing processes of plural fixed-site displacement, a long machine-hour and a short machine-hour can be carried out and tuned flexibly to operate individually by a few dies (mounts).

When a first die (mount) is performing the most time consuming manufacturing process at a fixed site, a second, third . . . die (mount) can rotate and displace at plural assigned fixed sites individually to carry out the manufacturing processes of an intermediate machine-hour and a short machine-hour.

To achieve the abovementioned object, the present invention provides a rotary table device which can operate simultaneously and individually, wherein the rotary table is constituted by a main frame, a round outer seal plate, a round inner seal plate, at least two driving wheels and at least two driven wheels. Each driven wheel is connected with a sliding block, and then an adapter plate is combined with a die (mount) fixing plate, followed by being emplaced on the sliding block. Each driving wheel can drive the corresponding driven wheel, so that the driving wheel can rotate annularly and independently in the track region and displace at a fixed site to perform all manufacturing processes.

To enable a further understanding of the said objectives and the technological methods of the invention herein, the brief description of the drawings below is followed by the detailed description of the preferred embodiments.

BRIEF DESCRIPTION OF THE DRAWINGS

FIG. 9-1 shows a first schematic view illustrating actions of increasing a fixed-site manufacturing process flexibly by a first and second mount on the rotary table of the present invention.

FIG. 9-2 shows a second schematic view illustrating actions of increasing a fixed-site manufacturing process flexibly by a first and second mount on the rotary table of the present invention.

FIG. 9-3 shows a third schematic view illustrating actions of increasing a fixed-site manufacturing process flexibly by a first and second mount on the rotary table of the present invention.

FIG. 9-4 shows a fourth schematic view illustrating actions of increasing a fixed-site manufacturing process flexibly by a first and second mount on the rotary table of the present invention.

FIG. 10-1 shows a first schematic view illustrating actions of increasing a fixed-site manufacturing process flexibly by a first and second mount on the rotary table of the present invention.

FIG. 10-2 shows a second schematic view illustrating actions of increasing a fixed-site manufacturing process flexibly by a first and second mount on the rotary table of the present invention.

FIG. 10-3 shows a third schematic view illustrating actions of increasing a fixed-site manufacturing process flexibly by a first and second mount on the rotary table of the present invention.

FIG. 10-4 shows a fourth schematic view illustrating actions of increasing a fixed-site manufacturing process flexibly by a first and second mount on the rotary table of the present invention.

FIG. 10-5 shows a fifth schematic view illustrating actions of increasing a fixed-site manufacturing process flexibly by a first and second mount on the rotary table of the present invention.

FIG. 11-1 shows a first schematic view illustrating actions of increasing a fixed-site manufacturing process flexibly by a first, second and third mount on the rotary table of the present invention.

FIG. 11-2 shows a second schematic view illustrating actions of increasing a fixed-site manufacturing process flexibly by a first, second and third mount on the rotary table of the present invention.

FIG. 11-3 shows a third schematic view illustrating actions of increasing a fixed-site manufacturing process flexibly by a first, second and third mount on the rotary table of the present invention.

FIG. 11-4 shows a fourth schematic view illustrating actions of increasing a fixed-site manufacturing process flexibly by a first, second and third mount on the rotary table of the present invention.

DETAILED DESCRIPTION OF THE PREFERRED EMBODIMENTS

Figure 1:
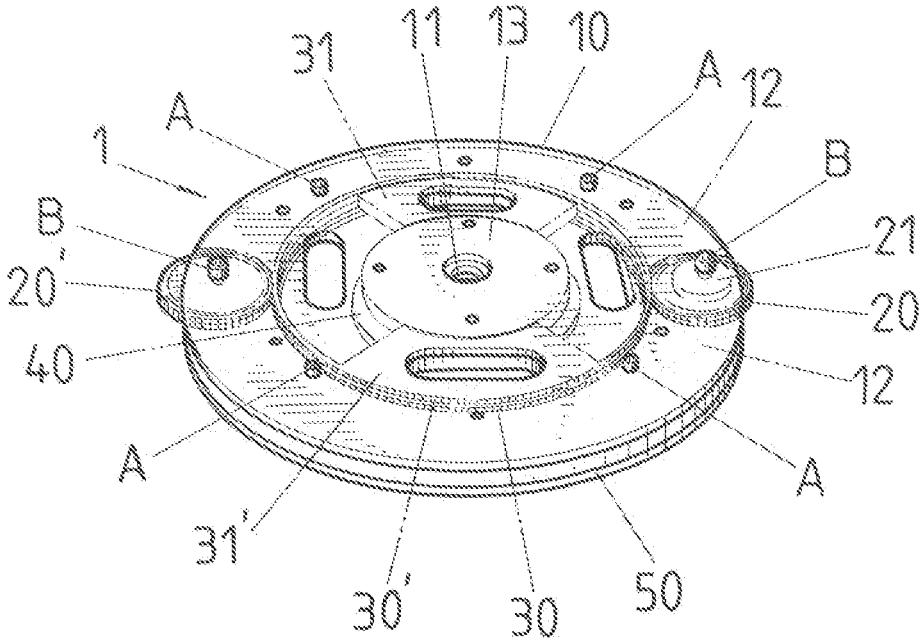
FIG. 1 shows a schematic view of the present invention.
Figure 2:
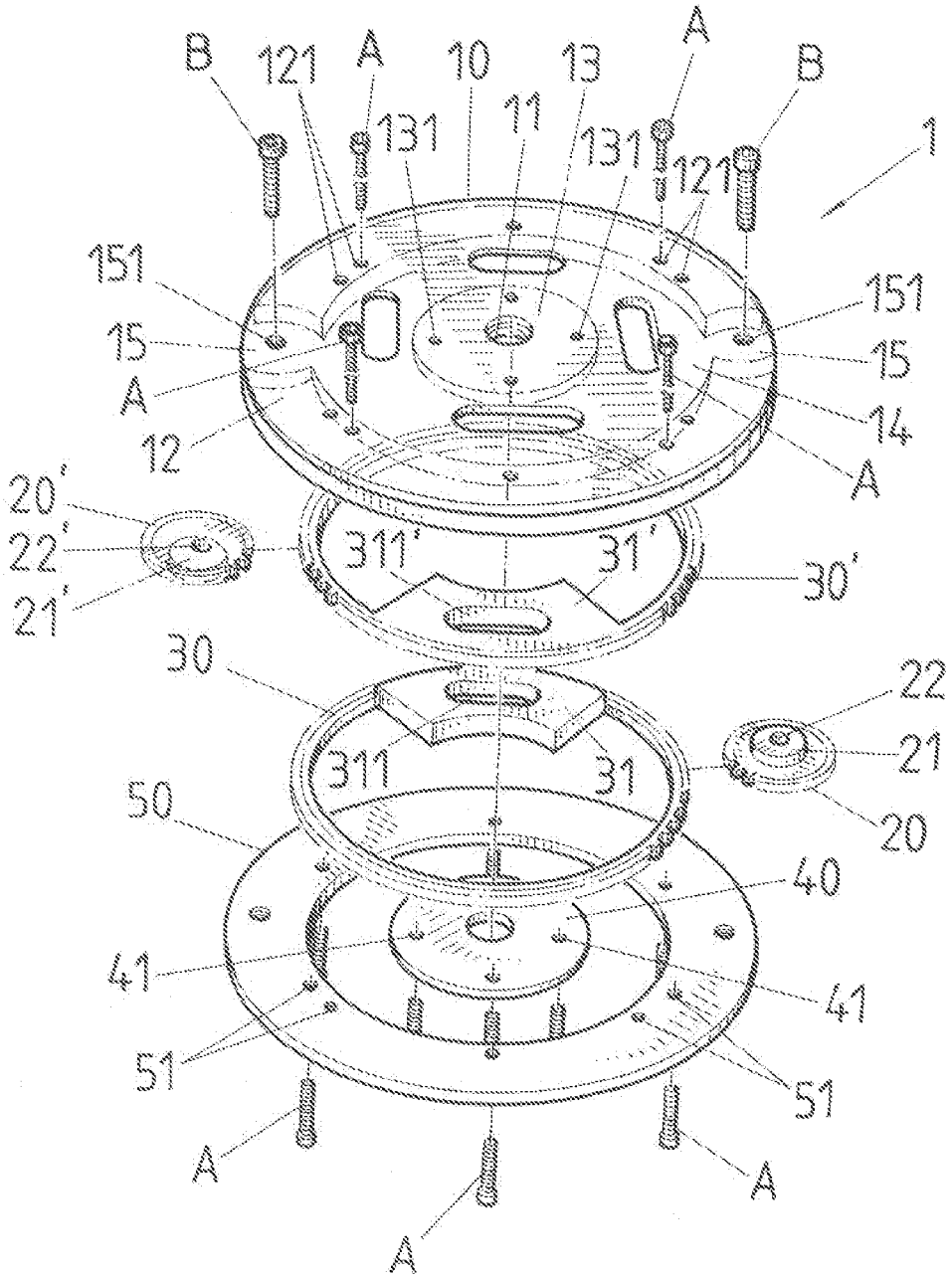
FIG. 2 shows an exploded perspective view of the present invention.

Referring to FIG. 1 and FIG. 2, a rotary table 1 of the present invention comprises:

a main frame 10, a center of which is provided with a rotary table central indexing hole 11, an interior side of which is provided with an inner annular track region 13, and an exterior side of which is provided with an outer annular track region 12, with that two driving-wheel emplacement regions 15 are provided respectively at a proper location on the outer annular track region 12, a driven-wheel annular track region 14 is provided between the inner and outer annular track regions 13, 12, each driving-wheel emplacement region 15 is provided with a driving-wheel central shaft hole 151 and plural screw holes 131, 121 are provided on the inner and outer annular track regions 13, 12;

at least two driving wheels 20, 20' which are installed respectively in the driving-wheel emplacement region 15 of the main frame 10, with that the driving wheels 20,20' are provided respectively with wheel blocks 21, 21' and shaft holes 22, 22', shafts B on the main frame 10 penetrate the central shaft holes 151 and are then locked in the shaft holes 22, 22' of the driving wheels 20, 20';

at least two driven wheels 30, 30' which are installed respectively in the driven-wheel annular track region 14 of the main frame 10, with that a side of the driven wheel 30 (30') is connected with a sliding block 31 (31') and then an adapter plate is combined with a die (mount) fixing plate followed by being emplaced on the sliding block 31 (31') or the sliding block 31 (31') is provided with a die cavity perforation 311 (311'), wherein the first driven wheel 30 is gnawed with the first driving wheel 20, the second driven wheel 30' is gnawed with the second driving wheel 20', etc.

and other than that the matched driving and driven wheels are gnawed with respect to each other, the rest un-matched wheels do not interfere with each other, with that the driving wheels 20, 20' can each drive individually the matched and gnawed driven wheels 30, 30' to rotate and displace;

a round inner seal plate 40 which is installed at one end of the inner annular track region 13 of the main frame 10 and is locked in screw holes 41 of the round inner seal plate 40 by transfixing screws A into the screw holes 131 of the main frame 10; and a round outer seal plate 50 which is installed at one end of the outer annular track region 12 of the main frame 10 and is locked in screw holes 51 of the round outer seal plate 50 by transfixing the screws A into the screw holes 121 of the main frame 10.

After the driving and driven wheels 20, 20', 30, 30' have been emplaced layer by layer, the round and outer seal plates 40, 50 are then fixed, allowing the driving and driven wheels 20, 20', 30, 30' not to get loose. The driving wheels 20, 20' can each drive individually the matched and gnawed driven wheels 30, 30' to rotate and displace.

Figure 3:
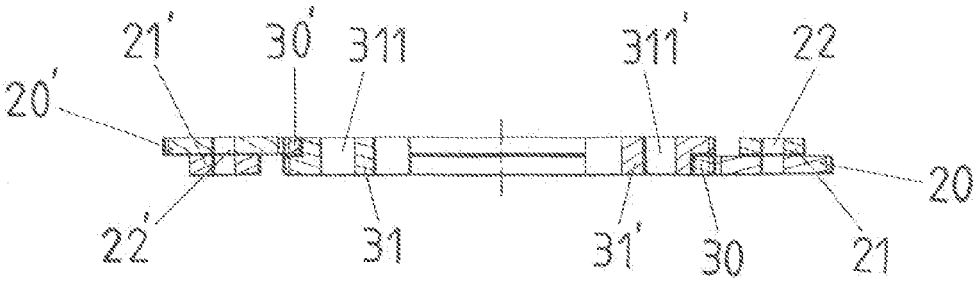
FIG. 3 shows a side planar view of a first and second driven wheel as well as a first and second driving wheel of the present invention.
Figure 4:
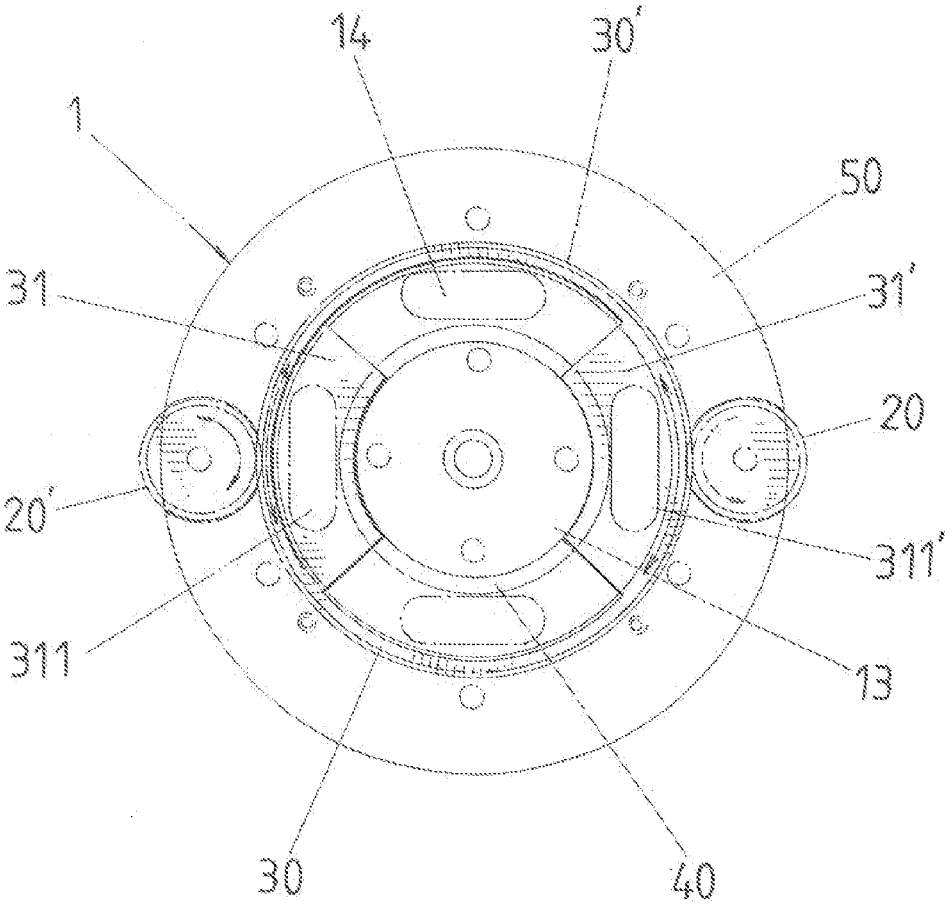
FIG. 4 shows a top view of the present invention.

The abovementioned rotary table 1 is a preferred embodiment of the present invention, wherein the first, second driven wheels 30, 30' and the first, second driving wheels 20, 20' can be also configured to be a combination of at least three sets of wheels. The power source to the first and second driving wheels 20, 20' can be a servo motor or an air piston. Referring to FIG. 3 and FIG. 4, the rotary table 1 uses power to drive the first and second driving wheels 20, 20', which simultanouesly and individually drive the first and second driven wheels 30, 30' to rotate.

Figure 5:
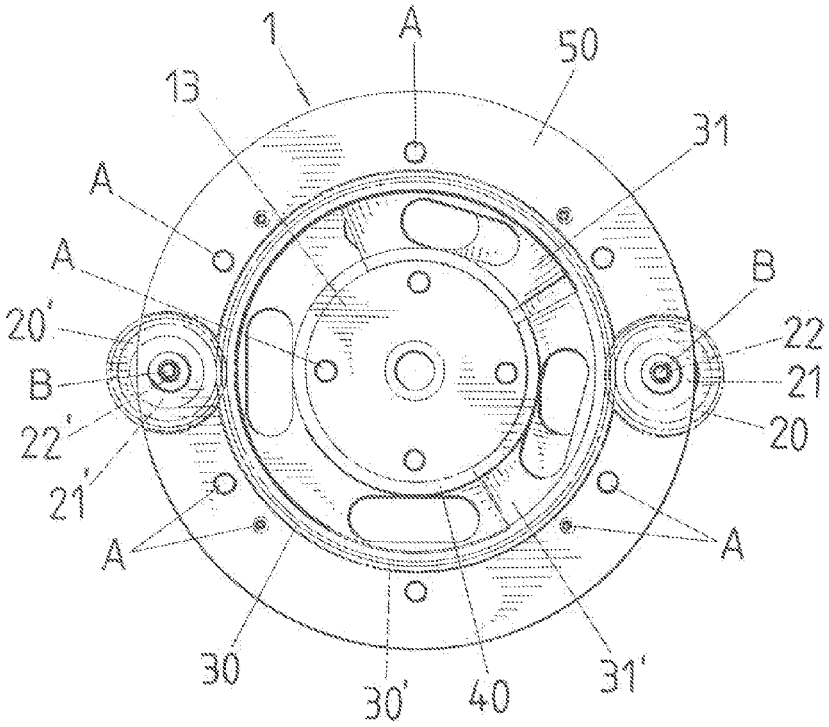
FIG. 5 shows a top view of a rotary table of the present invention, after being turned upside down.
Figure 6:
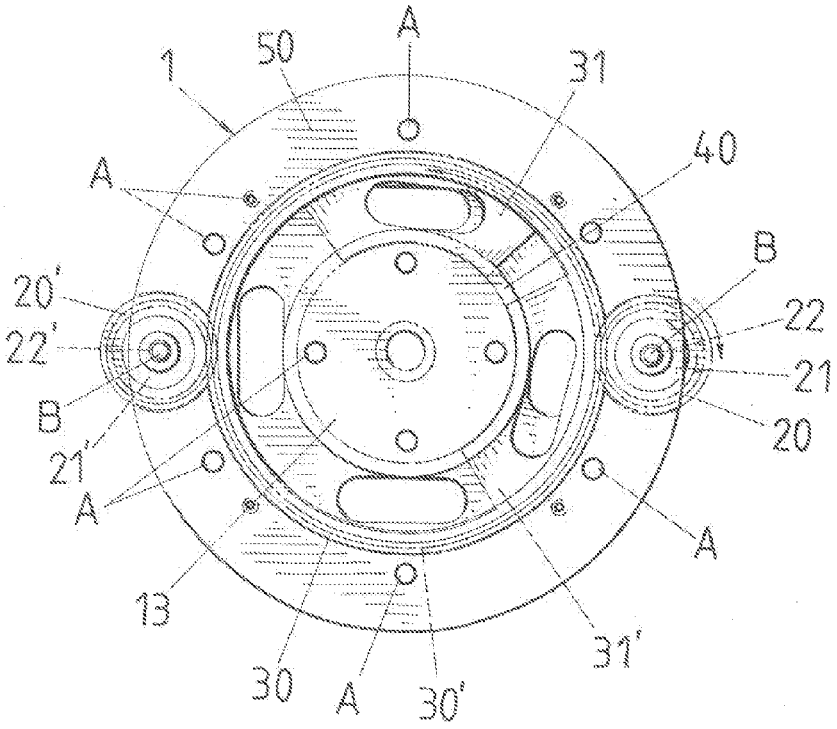
FIG. 6 shows a top view illustrating actions of the rotary table of the present invention, after being turned upside down.

Referring to FIG. 5 and FIG. 6, it shows top views of the rotary table 1 of the present invention, after being turned upside down. The sliding blocks 31, 31' of the first and second driven wheels 30, 30' are limited to driving of the first and second driven wheels 30, 30', allowing the two sliding blocks 31, 31' to form a simultaneous and individual operation. As shown in FIG. 6, when the first driving wheel 20 is rotating, the first driven wheel 30 can drive the sliding block 31 to displace.

Figure 7:
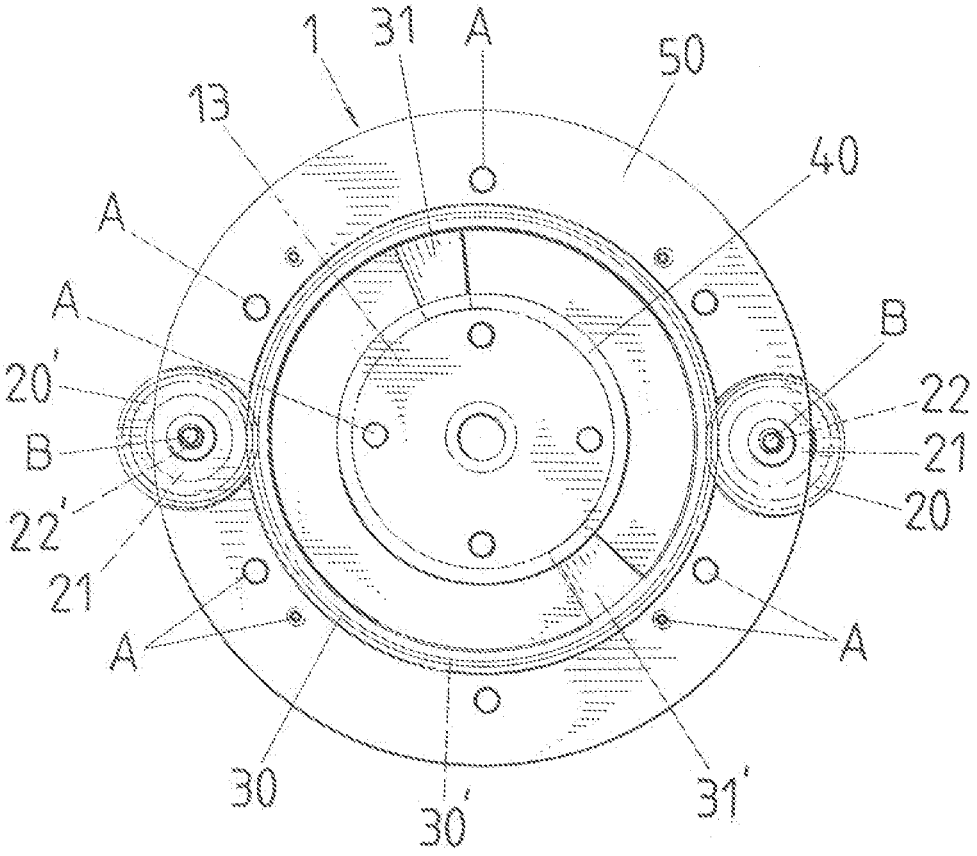
FIG. 7 shows a top view illustrating actions of the present invention.
Figure 8:
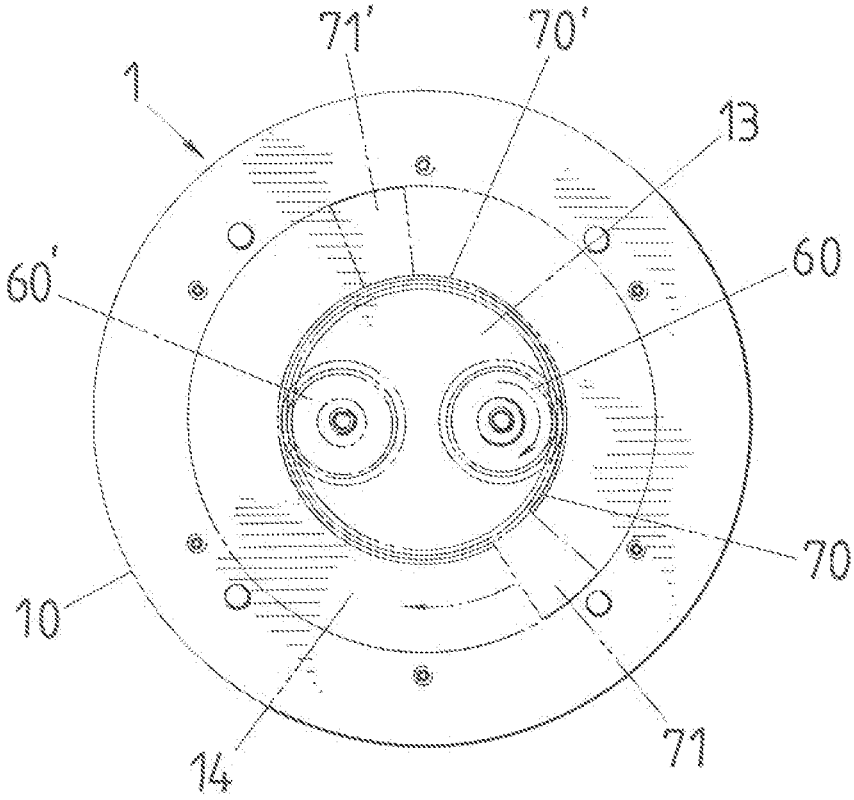
FIG. 8 shows another top view illustrating the actions of the present invention.
Figures 1, 9:
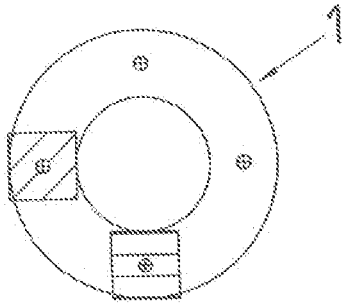
Figures 2, 9:
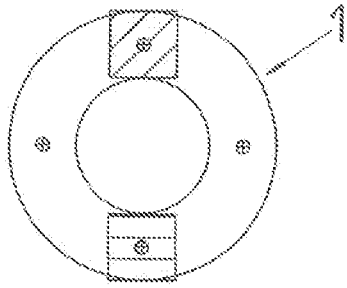
Figures 3, 9:
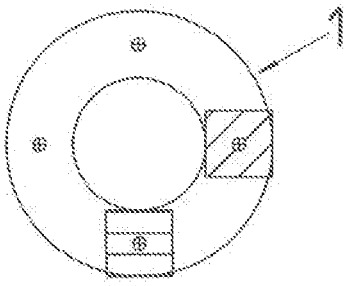
Figures 4, 9:
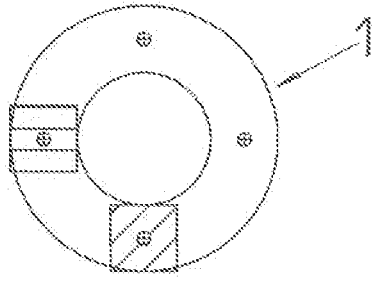
Figures 1, 10:
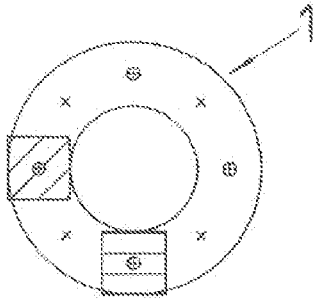
Figures 2, 10:
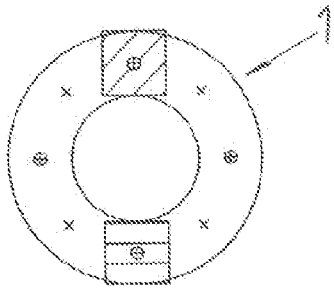
Figures 3, 10:
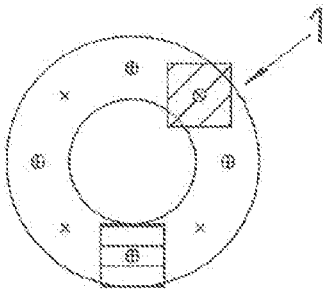
Figures 4, 10:
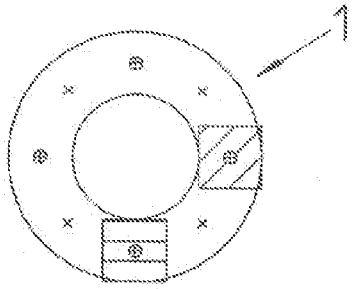
Figures 5, 10:
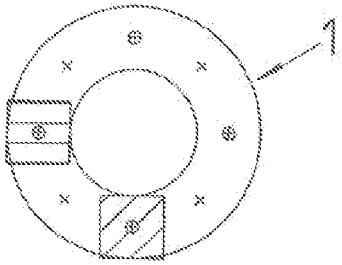

Referring to FIG. 7, it shows a top view of another embodiment of the rotary table 1 of the present invention, wherein the sliding blocks (or die fixing plates) 31, 31' that are connected by the first, second driven wheels 30, 30' can be also smaller mounts without the die cavity perforations. Referring to FIG. 8, it shows a top view of another embodiment of the rotary table 1 of the present invention, wherein the first, second driving wheels 60,60' proper locations of the inner annular track region 13 of the main frame 10, whereas the first and second driven wheels 70, 70' are installed on an inner annular of the driven-wheel annular track region 14 and are overlapped vertically. A side of the driven wheel 70 (70') is connected to a sliding block 71 (71') on which can be installed with a die (mount) fixing plate or a die (mount) fixing hole (not shown in the drawings). The first driven wheel 70 is gnawed with the first driving wheel 60, and the second driven wheel 70' is gnawed with the second driving wheel 60', etc. Referring to FIG. 9, it shows a manufacturing process of two mounts with four fixed sites. Referring to FIG. 10, it shows a flow diagram illustrating actions of dies on the sliding blocks 31, 31' of the rotary table 1, for a manufacturing process of two mounts with eight fixed sites. In FIG. 9, when the first mount is performing the most time consuming work at the original site, the second mount runs simultaneously from the fixed site in FIG. 9-1 to the fixed site in FIG. 9-2 and then to the fixed site in FIG. 9-3 individually, to perform the manufacturing process of plural sites and a short machine-hour. As shown in FIG. 9-4, when the first mount accomplishes the most time consuming work, the first and second mounts displace simultaneously. Referring to FIG. 10, the manufacturing process of two mounts with four fixed sites in FIG. 9-2 is increased to the manufacturing process of two mounts with eight fixed sites.

Figures 1, 11:
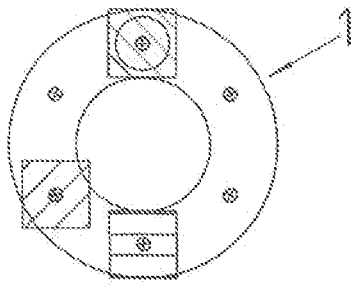
Figures 2, 11:
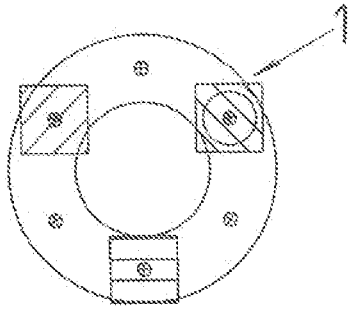
Figures 3, 11:
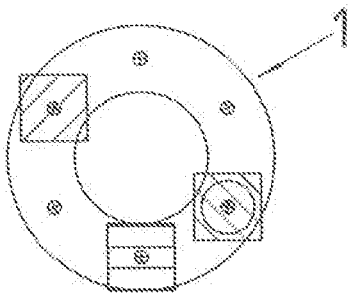
Figures 4, 11:
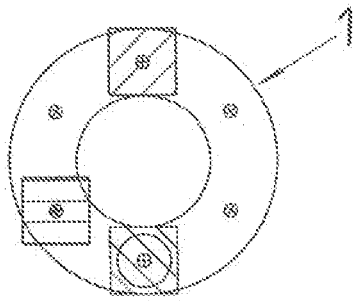

Referring to FIG. 11, the rotary table 1 of the present invention is an embodiment of a manufacturing process of three mounts with six fixed-site, formed by three driving wheels, three driven wheels and three mounts In conclusion, the present invention is to provide a rotary table device which can be tuned flexibly to operate individually, when the first die (mount) is performing a long machine-hour manufacturing process at a fixed site, the second, third . . . driving wheel can each drive the matched drive wheel to rotate and displace to perform plural short machine-hour manufacturing processes at plural fixed sites, so that all the manufacturing processes can be accomplished simultaneously to decrease the operation time, the cost of dies (mounts) and the die-change time, thereby reducing the percent defective and increasing the capacity.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A rotary table device which can be tuned flexibly to operate individually, the rotary table comprising:

a main frame, an interior side of which is provided with an inner annular track region, and an exterior side of which is provided with an outer annular track region, two driving-wheel emplacement regions provided at proper locations on the outer annular track region and a drive-wheel annular track region is provided between the inner annular track region and the outer annular track region;

at least two driving wheels which are installed respectively in the two driving-wheel emplacement region of the main frame;

at least two driven wheels which are installed respectively in the driven-wheel annular track region of the main frame, with that a side of each driven wheel is connected with a sliding block, each driven wheel is matched and gnawed with the driving wheel, and each driving wheel drives the matched and gnawed driven wheel to rotate and displace;

a round inner seal plate which is installed at one end of the inner annular track region of the main frame; and a round outer seal plate which is installed at one end of the outer annular track region of the main frame.

2. The rotary table device which can be tuned flexibly to operate individually, according to claim 1, wherein the driving-wheel emplacement regions are provided on the outer annular track region of the main frame.

3. The rotary table device which can be tuned flexibly to operate individually, according to claim 1, wherein the driving-wheel emplacement regions are provided on the inner annular track region of the main frame.

4. The rotary table device which can be tuned flexibly to operate individually, according to claim 1, wherein the sliding block of each driven wheel provides for emplacement of an adapter plate after the adapter plate has been combined with a die (mount) fixing plate.

* * * * *